US007208726B2

(12) United States Patent
Hidalgo et al.

(10) Patent No.: US 7,208,726 B2
(45) Date of Patent: Apr. 24, 2007

(54) ION TRAP MASS SPECTROMETER WITH SCANNING DELAY ION EXTRACTION

(75) Inventors: August Hidalgo, San Francisco, CA (US); Stuart C. Hansen, Palo Alto, CA (US); Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 10/927,874

(22) Filed: Aug. 27, 2004

(65) Prior Publication Data

US 2006/0043282 A1 Mar. 2, 2006

(51) Int. Cl.
*H01J 49/00* (2006.01)
*H01J 49/40* (2006.01)

(52) U.S. Cl. ..... 250/281; 250/282; 250/287; 250/286; 250/292

(58) Field of Classification Search ..... None
See application file for complete search history.

(56) References Cited

U.S. PATENT DOCUMENTS

| | | | | |
|---|---|---|---|---|
| 6,627,883 | B2 * | 9/2003 | Wang et al. | 250/292 |
| 2001/0030284 | A1 * | 10/2001 | Dresch et al. | 250/287 |
| 2002/0030159 | A1 * | 3/2002 | Chernushevich et al. | 250/287 |
| 2003/0132377 | A1 * | 7/2003 | Bateman et al. | 250/281 |

* cited by examiner

*Primary Examiner*—Nikita Wells

(57) ABSTRACT

An apparatus for analyzing ions is described. The apparatus includes an ion source, an ion trap positioned to receive ions from the ion source; a time of flight mass analyzer, and a detector operatively coupled to the time of flight. The time of flight mass analyzer includes a pulser region, and the pulser region is positioned to receive ions from the ion trap. The apparatus further includes a scanning delay timing circuit in operable relation to the pulser region. The scanning delay timing circuit is adapted to triggering an extraction pulse at the pulser region. Methods of analyzing ions by mass spectrometry are also described.

21 Claims, 5 Drawing Sheets

ION TRAP MASS SPECTROMETER WITH SCANNING DELAY ION EXTRACTION

FIELD OF THE INVENTION

The invention relates generally to mass spectrometer devices, which are useful in analysis of ions, and other applications. More specifically, the invention relates to methods of analyzing ions using a mass spectrometer that includes a linear ion trap.

BACKGROUND OF THE INVENTION

Mass spectrometry systems are analytical systems used for quantitative and qualitative determination of the compositions of materials, which include chemical mixtures and biological samples. In general, a mass spectrometry system uses an ion source to produce electrically charged particles (e.g., molecular or polyatomic ions) from the material to be analyzed. Once produced, the electrically charged particles are introduced to the mass spectrometer and separated by a mass analyzer based on their respective mass-to-charge ratios. The abundance of the separated electrically charged particles are then detected and a mass spectrum of the material is produced. The mass spectrum provides information about the mass-to-charge ratio of a particular compound in a mixture sample and, in some cases, information about the molecular structure of that component in the mixture.

For determining molecular weight of a compound, mass spectrometry systems employing a single mass analyzer are widely used. These analyzers include a quadrupole (Q) mass analyzer, a time-of-flight (TOF) mass analyzer, ion trap (IT-MS), and etc. For more complicated molecular structure analysis, however, tandem mass spectrometers (Tandem-MS or MS/MS) are often needed. Tandem mass analyzers typically consist of two mass analyzers of the same or of different types, for instance TOF-TOF MS or Q-TOF MS. In a tandem MS analysis, ionized particles are sent to the first mass analyzer and an ion of particular interest is selected. The selected ion is typically transmitted to a collision cell where the selected ion is fragmented. The fragment ions are transmitted to the second mass analyzer for mass analysis. The fragmentation pattern obtained from the second mass analyzer can be used to determine the structure of the corresponding molecules.

For example, in a triple quadrupole (QQQ) mass spectrometer an ionization source produces a plurality of parent ions. The first quadrupole is used as a mass analyzer to select a particular parent ion. Then, the selected parent ion is dissociated into daughter ions in the second quadrupole via photodissociation and/or collisionally induced dissociation. Subsequently, the third quadrupole is used as a mass analyzer to separate the daughter ions based on their respective mass-to-charge ratios. The resulting mass spectrum can be used to identify the daughter ions, which can be useful in identifying the structure of the selected parent ion.

In the example described above, the second quadrupole can be used as a collision cell to facilitate collision induced dissociation of the selected parent ion. In such a collision cell, the selected parent ions are sent into an RF quadrupole field which is pressurized up to approximately 1 to 10 mbar with a background gas (normally an inert gas such as argon). When the parent ions collide with the background gas, a portion of the translation energy of the parent ions is converted into activation energy that is sufficiently high to break certain molecular bonds to form daughter ions. The RF quadrupole field facilitates confinement of the daughter ions and the remaining parent ions until further mass analysis. The fragment pattern produced characterizes the original molecule and provides information about its structure.

In combination with other ion optic elements, an RF quadrupole can also be used as an ion trap for storage of ions. A potential gradient is formed along the axis of the quadrupole, and ions are trapped in a potential well. The ion trapping provides a possibility for performing ion accumulation, charge reduction, and ion-ion chemistry. In some tandem mass spectroscopy applications, an ion collision cell/linear ion trap is also used as a mass selective device. A molecular ion of a given mass is selected, isolated, and stored. Ion-gas collisions and/or ion-ion reactions may also be performed.

When the quadrupole is used as a linear ion trap or as a collision cell, specific potential distributions are formed along the axis of the quadrupole. In a linear ion trap, a potential well is formed for confining ions (which may be either positively or negatively charged). The potential well typically is formed by using a quadrupole with gate electrodes at each end of the quadrupole. Holding the gate electrodes at a relatively "high" potential (at "trapping potential") and the quadrupole at a relatively "low" potential provides the potential well that confines the ions. In a collision cell, a potential gradient is necessary for accelerating ions along the axis of the quadrupole. This potential distribution is typically formed by using an evenly segmented quadrupole and applying a DC potential gradient to the different segments of the quadrupole. Opening the potential well by lowering the potential at the exit gate electrode allows ions to be released from the linear ion trap; lowering the exit gate electrode potential for a short period of time and then returning the exit gate electrode to the "trapping potential" releases a short burst of ions (an "ion packet"). The ion packet may be directed towards another component of the mass spectrometer, such as a mass analyzer and/or a detector.

Manipulation of ions in a mass spectrometer is dependent upon the controlled application of specific RF and/or DC potentials to components of the mass spectrometer, e.g. applying potentials to a quadrupole, applying gate potentials, or applying suitable potentials in a TOF mass analyzer. What is needed is an apparatus which provides for the needed RF and/or DC potential distributions needed for manipulating ions in a mass spectrometer.

SUMMARY OF THE INVENTION

The invention addresses the aforementioned technology, and provides an apparatus for analyzing ions, as well as methods for the analysis of ions. The apparatus includes an ion source, an ion trap disposed to receive ions from the ion source, and a time of flight mass analyzer having a pulser region disposed to receive ions from the ion trap. A detector is operably coupled to the time of flight mass analyzer. The apparatus also includes a scanning delay timing circuit in operable relation to the time of flight mass analyzer. The scanning delay timing circuit is adapted to triggering an extraction pulse at the pulser region. The scanning delay timing circuit is operable to provide a scanning delay between the release of ions from the ion trap and the triggering of the extraction pulse.

In accordance with the present invention, methods of analyzing ions are also provided. In an embodiment, a method is provided for analyzing ions in a mass spectrometer, wherein the mass spectrometer includes a ion trap, a time of flight mass analyzer, and a detector. In the embodiment, a delay period is selected. The method includes releasing an ion packet from the ion trap, wherein the ion trap is only partially emptied; waiting the delay period; and then producing an extraction pulse to accelerate a portion of the ion packet into the time of flight mass analyzer to the detector. The delay period is adjusted, e.g. providing for a shorter delay period or a longer delay period. The steps of releasing an ion packet, waiting the delay period, and producing an extraction pulse are repeated. The delay period is scanned over a range that provides for accelerating different portions of the ion packet into the time of flight mass analyzer to the detector. In an embodiment the method includes accumulating data from the detector and producing a mass spectrum over a m/z range that is larger than the m/z range provided by a constant (not scanned) delay period. In an embodiment the steps of releasing an ion packet, waiting, and producing an extraction pulse are performed at least twice each time the delay period is adjusted.

Additional objects, advantages, and novel features of this invention shall be set forth in part in the descriptions and examples that follow and in part will become apparent to those skilled in the art upon examination of the following specifications or may be learned by the practice of the invention. The objects and advantages of the invention may be realized and attained by means of the instruments, combinations, compositions and methods particularly pointed out in the appended claims.

BRIEF DESCRIPTION OF THE DRAWINGS

These and other features of the invention will be understood from the description of representative embodiments of the method herein and the disclosure of illustrative apparatus for carrying out the method, taken together with the Figures, wherein FIG. 1 schematically illustrates a mass spectrometer in accordance with the present invention.

To facilitate understanding, identical reference numerals have been used, where practical, to designate corresponding elements that are common to the Figures. Figure components are not drawn to scale.

DETAILED DESCRIPTION

Before the invention is described in detail, it is to be understood that unless otherwise indicated this invention is not limited to particular materials, reagents, reaction materials, manufacturing processes, or the like, as such may vary. It is also to be understood that the terminology used herein is for purposes of describing particular embodiments only, and is not intended to be limiting. It is also possible in the present invention that steps may be executed in different sequence where this is logically possible. However, the sequence described below is preferred.

It must be noted that, as used in the specification and the appended claims, the singular forms "a," "an" and "the" include plural referents unless the context clearly dictates otherwise. Thus, for example, reference to a gate electrode includes a plurality of gate electrodes. Similarly, a "set" of an item as recited in the description includes embodiments where the set includes a single item and also embodiments in which a plurality of the items are in the set.

As used herein "lower value" and "upper value", in the context of a range having a lower value and an upper value of the range, should be understood to reference the values of the lower and upper limits of the range. Such lower and upper limits may be determined as needed to provide a range (e.g. range of values, another e.g. range of n, yet another e.g. range of delay period). The range may be determined by any appropriate method, based on various parameters, such as operational limits of the apparatus and characteristics of the sample (and ions produced from the sample), as will be apparent to one of ordinary skill in the art given the disclosure herein. In certain embodiments the range may be determined empirically.

"Scanning", as used herein in the context of a scanning delay timing circuit or scanning the delay period or like context, references automatically adjusting the time period between the release of an ion packet from the ion trap and triggering an extraction pulse (the "delay period"), such that the delay period is varied over a range of delay period. A scanning delay timing circuit provides for automatically adjusting the delay period. Scanning the delay period references altering the delay period over a range of delay period, e.g. by incrementing or decrementing the delay period or otherwise adjusting the delay period over a range of delay period. In typical embodiments, the present invention provides for accumulating data from analyzing many ion packets in a mass spectrometer to provide a final mass spectrum. The delay period is adjusted in conjunction with the analysis of the ion packets and accumulation of data for generating a final mass spectrum. The final mass spectrum is the generated from the accumulation of data from analyzing many ion packets in a mass spectrometer.

DETAILED DESCRIPTION OF EMBODIMENTS

Figure 1:
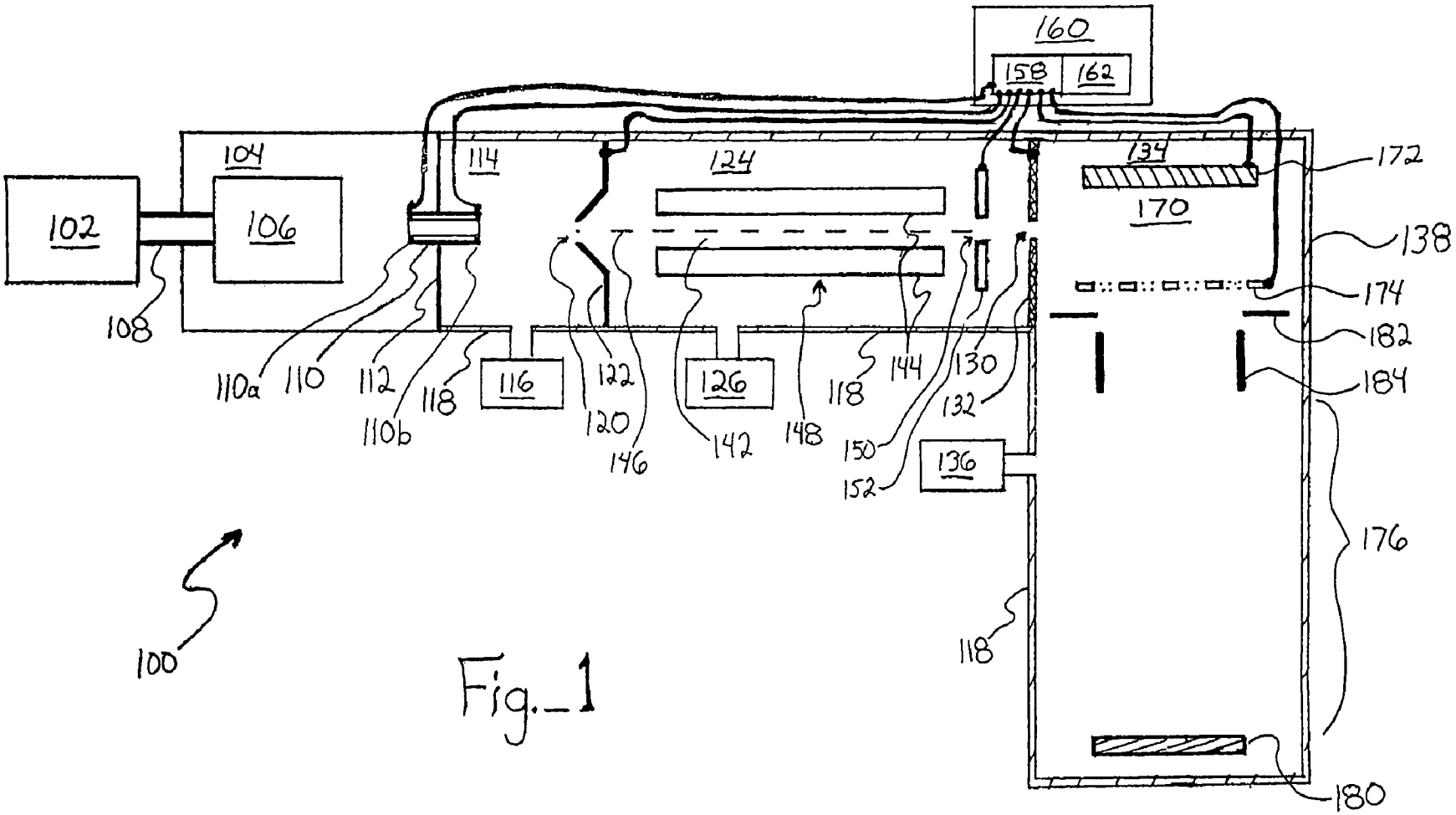

Referring now to FIG. 1, a mass spectrometer 100 in accordance with the invention is described. Mass spectrometer 100 includes a conventional sample source 102, which can be a liquid chromatograph, a gas chromatograph, or any other desired source of sample. From sample source 102, a sample is conducted via interface tube 108 to an ion source 106 which ionizes the sample. Ion source 106 can be (depending on the type of sample) an electrospray or ion spray device, or chemical ionization, or MALDI, or photo ionization it can be any other ion source suitable for providing ions to be analyzed in the mass spectrometer 100. Various ion sources are described in U.S. Pat. Nos. 4,935,624, 4,861,988, and 4,501,965.

Ion source 106 is located in chamber 104. From ion source 106, ions are directed through a transfer capillary 110 supported in plate 112 and into a first stage vacuum chamber 114 pumped e.g. to a pressure of about 1 torr by a vacuum pump 116. The transfer capillary 110 has an input end 110*a* and an output end 10*b*; the input end 110*a* and output end 110*b* are each adapted to have applied potentials for directing ions (e.g. focusing and/or accelerating the ions). The ions then travel through a skimmer opening 120 in a skimmer 122 and into a vacuum chamber 124. Vacuum chamber 124 is pumped e.g. down to a pressure of about 1 to about 10 millitorr by pump 126. An orifice 130 in plate 132 connects vacuum chamber 124 with a vacuum chamber 134 of a time of flight mass analyzer 138, which is pumped e.g. to a pressure of about 10^−5 millitorr to about 10^−4 millitorr by pump 136. The vacuum chambers 114, 124 and the time of flight mass analyzer have housings 118 for separating the interiors of the vacuum chambers and the time of flight mass analyzer from the ambient air.

Mass spectrometer 100 includes a multipole linear ion trap 148. The multipole linear ion trap 148 includes a set of rods 144 extending substantially parallel to each other around a common central axis (indicated by dotted line 146) such that the set of rods 144 define an elongated interior volume 142. The set of rods 144, generically referenced as a "multipole," typically includes an even number of rods, e.g. four, six, or eight rods (quadrupole, hexapole, or octopole, respectively), or more. In the embodiments described in the Figures, herein, the multipoles described are quadrupoles; however, it will be appreciated that multipoles employed in embodiments described herein may have more than four rods and such multipoles are within the scope of the invention. The multipole may be a segmented multipole, such as an evenly segmented multipole, and unevenly segmented multipole (such as described in U.S. Pat. application Ser. No. 10/837,205 to Li, filed Apr. 30, 2004), or may have any other configuration adapted to function as a multipole linear ion trap. Although the embodiments illustrated in the Figures describe a mass spectrometer with a multipole linear ion trap, any ion trap adapted to receiving ions from an ion source, trapping the ions, and controllably releasing ions in ion packets may be employed in accordance with the present invention, for example, a mass spectrometer having a three dimensional ion trap. An exit gate electrode 152 having a gate aperture 150 is located adjacent the downstream terminus of the set of rods 144. Appropriate radiofrequency (RF) and/or direct current (DC) potentials are applied to opposed pairs of rods of the set of rods 144, and also to the various ion optical elements 110*a*, 110*b*, 122, and 132 by a power supply 158 which is part of a controller 160.

The time of flight mass analyzer 138 comprises a pulser region 170 having a repeller plate 172 and draw-out grid 174. In particular embodiments, the controller 160 comprises the scanning delay timing circuit 162, which is operable to trigger an extraction pulse in the pulser region 170. In certain embodiments the scanning delay timing circuit 162 comprises electronic components (e.g. integrated circuits, capacitors, resistors, op amps, power supplies) configured to provide the scanning delay operation for triggering the extraction pulse. In some embodiments the scanning delay timing circuit 162 comprises a microprocessor with an interface adapted to triggering the extraction pulse. In some embodiments, the controller 160 comprises a programmable logic unit and interface capable of controlling one or more power supplies 158 and the scanning delay timing circuit during typical operation of the mass spectrometer, e.g. controlling potentials at ion optic elements, controlling timing of events such as switching potentials applied to ion optic elements, etc. Suitable controllers and control methods are known to those skilled in the art.

Deflector lens 184 and other electrostatic elements 182, if present, may be used to shape and direct the path of ions through the time of flight mass analyzer 138. The time of flight mass analyzer 138 also comprises a drift region 176. A detector 180 is disposed adjacent the drift region 176 to receive and detect ions analyzed in the time of flight mass analyzer 138. An ion flight path is defined by the mass spectrometer 100 as originating at ion source 106, from the ion source 106 traveling in order through the transfer capillary 110, the skimmer opening 120, the interior volume 142 of the set of rods 144, the gate aperture 150, the orifice 130, the pulser region, and the drift region 176 to the detector 180. As used herein, "downstream" references a direction (or a component) generally closer to the detector along the ion flight path, and "upstream" references a direction (or a component) generally closer to the ion source along the ion flight path.

In use, normally a RF potential is applied to the set of rods 144, plus a DC rod offset voltage which is applied uniformly to all the rods. This rod offset voltage delivers the electric potential inside the rod set (the axial potential). Because the rods have conductive surfaces, and the rod offset potential is applied uniformly to each of the rods, the potential is constant throughout the length of the set of rods, so that the electric field in an axial direction is zero (i.e. the axial field is zero). Potentials at the ion optic elements at opposite ends of the set of rods, including skimmer 122 and exit gate electrode 152, are controlled to establish a trapping potential capable of confining ions generally within the interior volume 142 defined by the set of rods 144. The multipole 148 thus is configured as an ion trap. The RF potentials and/or DC offsets applied are controlled to accumulate ions in the ion trap and to controllably release ion packets to be analyzed in the time of flight mass analyzer 138.

The values of the potentials will vary depending on the experimental conditions, and the ions of interest, and are generally easily determined by one of skill in the art given the disclosure herein. In a typical example in which positive ions are analyzed, the applied potentials will typically be in the range from about −2000 to about −5000 volts DC (more typically about −3000 to about −4000 volts DC) on the input end 110*a* of transfer capillary 110; from about 5 to about 300 volts DC (more typically about 50 to about 250 volts DC) on the output end 110*a* of transfer capillary 110; from about 5 to about 250 volts DC (more typically about 50 to about 100 volts DC) on the skimmer 122; from about 0 to about 100 volts DC (more typically about 10 to about 50 volts DC) offset on the rods 144; and from about 0 to about 100 volts DC (more typically about 10 to about 100 volts DC) on exit electrode 152. The extraction pulse in typical embodiments may be in the range of 100 to 3000 volts DC (more typically about 500 to about 1500 volts DC). Applied RF potentials will typically be in the range from about 100 to about 5000 volts peak-to-peak. The potentials may also be adjusted outside these ranges, if desired, as long as the apparatus functions as described.

Once an ion packet is released from the ion trap, the ion packet enters the pulser region 170 of the time of flight mass analyzer 138. The scanning delay timing circuit 162 provides for a delay period between the release of the ion packet from the ion trap and the triggering of the extraction pulse. During the delay period the ion packet travels from the ion trap to the pulser region 170. The delay period is timed to trigger the extraction pulse when at least a portion of the ion packet is in the pulser region 170 such that the portion of the ion packet is accelerated through the time of flight mass analyzer 138 to the detector 180. In typical embodiments of the present invention, the ion packet is subject to spatial dispersion, i.e. the ion packet becomes broader as it travels towards the pulser region 170. The initial size of the ion packet will depend on a number of factors including the length of time the exit gate potential is altered to open the exit gate (the "release duration") and the energy of the ions as they are ejected from the ion trap. The ion packet is released from the ion trap and follows an ion flight path between the ion trap and the pulser region 170. As the packet travels from the ion trap to the pulser region 170, mass separation of ions within the packet will typically occur. Smaller (lower mass) or more highly charged ions will have faster velocities and will tend to move toward the leading edge of the packet. Larger (heavier mass) and less highly charged ions will have slower velocities and will tend to lag towards the trailing edge of the packet. Also, the size of the ion packet will tend to increase as it travels towards the pulser region 170.

Figure 2:
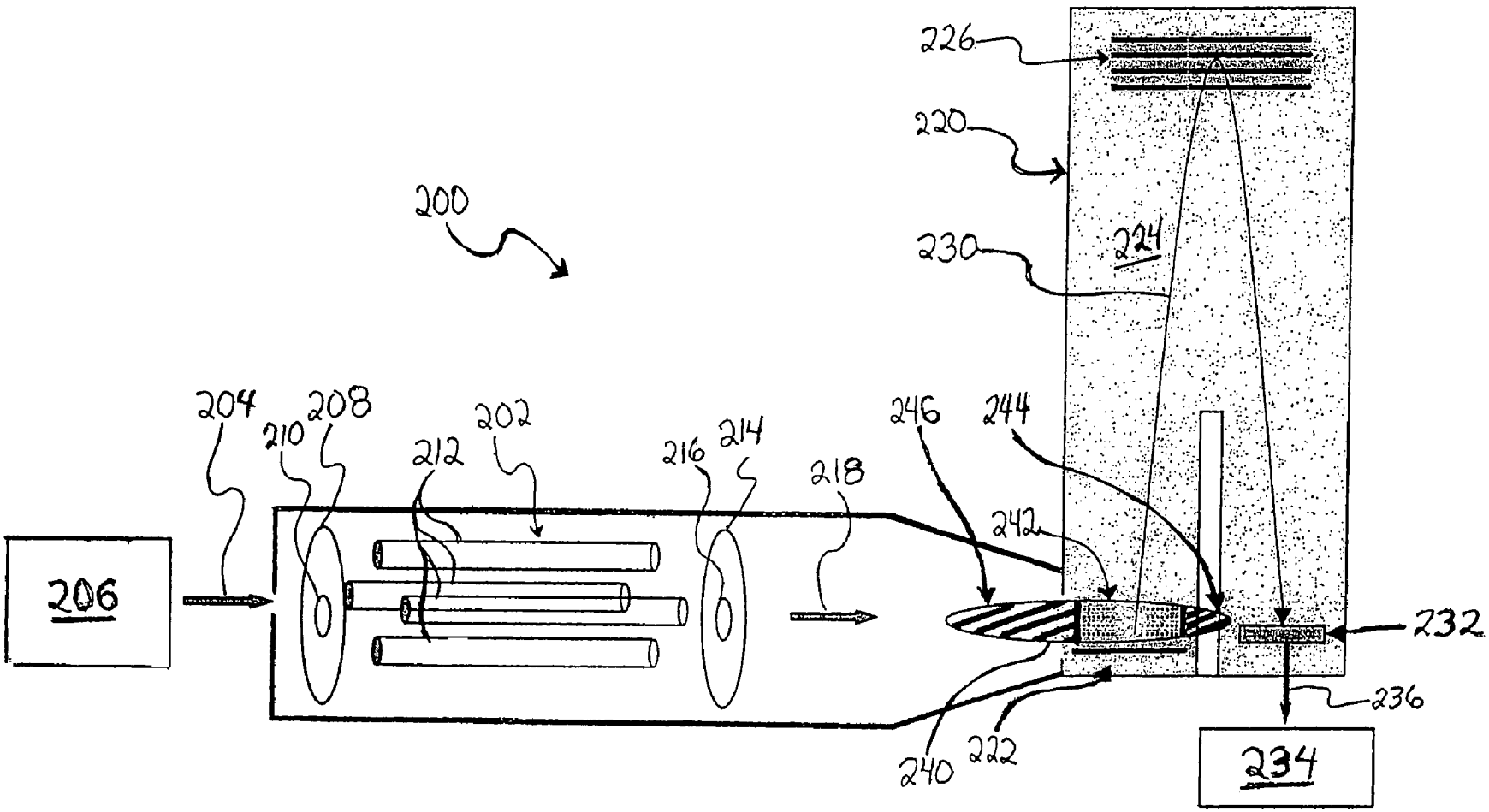
FIG. 2 schematically depicts another mass spectrometer in accordance with the present invention.

In embodiments of the present invention, the ion packet typically will be larger than can be effectively accelerated by an extraction pulse in the pulser region. In this context "larger than can be effectively accelerated" refers to at least a portion of the ion packet (e.g. at least 20%, or at least 40%, or at least 80%) remaining outside the pulser region such that the portion of the ion packet remaining outside the pulser region will not be accelerated towards the detector. In other words, only a portion of the ion packet (e.g. less than 80%, less than 60%, less than 40%, less than 20%, less than 10%, or less than 5% of the ion packet) is available at any instant in the pulser region to be accelerated towards the detector. Thus, the ion packet is typically distributed across a longer space than can be accommodated in the pulser region. This is illustrated in FIG. 2, which schematically shows another embodiment of a mass spectrometer 200 in accordance with the present invention. In FIG. 2, a linear ion trap 202 is disposed to receive ions (indicated by arrow 204) from an ion source 206. The linear ion trap 202 includes an inlet gate electrode 208 having an inlet aperture 210, a multipole (illustrated as a quadrupole 212), and an exit gate electrode 214 having an exit aperture 216. Although FIG. 2 illustrates a mass spectrometer with a multipole linear ion trap, any ion trap adapted to receiving ions from an ion source, trapping the ions, and controllably releasing ions in ion packets may be employed in accordance with the present invention, for example, a mass spectrometer having a three dimensional ion trap. The linear ion trap 202 is adapted to release an ion packet in the direction indicated by arrow 218 towards a time of flight mass analyzer 220. The time of flight mass analyzer 220 has a pulser region 222 adapted to producing an extraction pulse. Ions accelerated by the extraction pulse travel through the drift region 224 of the time of flight mass analyzer 220 and are redirected by a reflectron 226 disposed at an end of the time of flight mass analyzer 220 opposite the pulser region 222; the ions thus travel in an ion flight path that includes the path generally indicated by arrow 230. Ions accelerated by the extraction pulse that travel through the drift region 224 are detected by a detector 232 operably coupled to the time of flight mass analyzer 220. Data from the detector are sent to a data system 234 in communication with the detector 232, as indicated by arrow 236. FIG. 2 illustrates an ion packet 240 that is larger than the pulser region 222. Since the extraction pulse is relatively brief compared to the time it takes for the ion packet 240 to completely traverse the pulser region 222 (traveling in the direction indicated by arrow 218), only a portion 242 of the ion packet 240 is accelerated along the path indicated by arrow 230 towards the detector 232. In FIG. 2, a leading portion 244 of the ion packet 240 and a trailing portion 246 of the ion packet 240 are not accelerated by the extraction pulse through the time of flight mass analyzer 220 to the detector 232. The timing of the extraction pulse relative to the release of the ion packet from the linear ion trap (corresponding to the delay period) and the size of the pulser region and detector will determine which portion of the ion packet will be accelerated by the extraction pulse.

Typically, to produce a mass spectrum from a sample, the sample is ionized to produce ions that are introduced into the ion trap. A portion of the ions (the "ion packet") is released from the ion trap and is then analyzed in the mass analyzer and detected by the detector. The portion of ions released from the ion trap in a single ion packet will depend on a number of experimental parameters, including configuration of the ion trap, the mass of the ions in the ion trap, the distribution of ions in the ion trap, the energy of the ions in the ion trap, the release duration, as well as other factors. Typically, the percentage of ions in the ion trap released to form a single ion packet will be in the range from about 0.1% to about 20% of the total amount of ions in the ion trap, e.g. from about 0.2% to about 10%, or from about 0.5% to about 5%. Typically, the percentage of ions in the ion trap released to form a single ion packet will vary inversely with the number of times the delay period is scanned over the range of delay period, the number of times the delay period is changed over one scan over the range of delay period, and the number of times ion packets are analyzed without changing the delay period. Typically, data received from a single ion packet is insufficient to provide a mass spectrum; thus, up to ten thousand or more ion packets may be analyzed and the data accumulated to produce the final mass spectrum. The entire process typically is relatively rapid, taking from less than a tenth of a second to perhaps ten seconds to ionize the sample, release the individual ion packets, analyze each ion packet, accumulate the data from the analyses of the ion packets, and produce the final mass spectrum.

Figure 3:
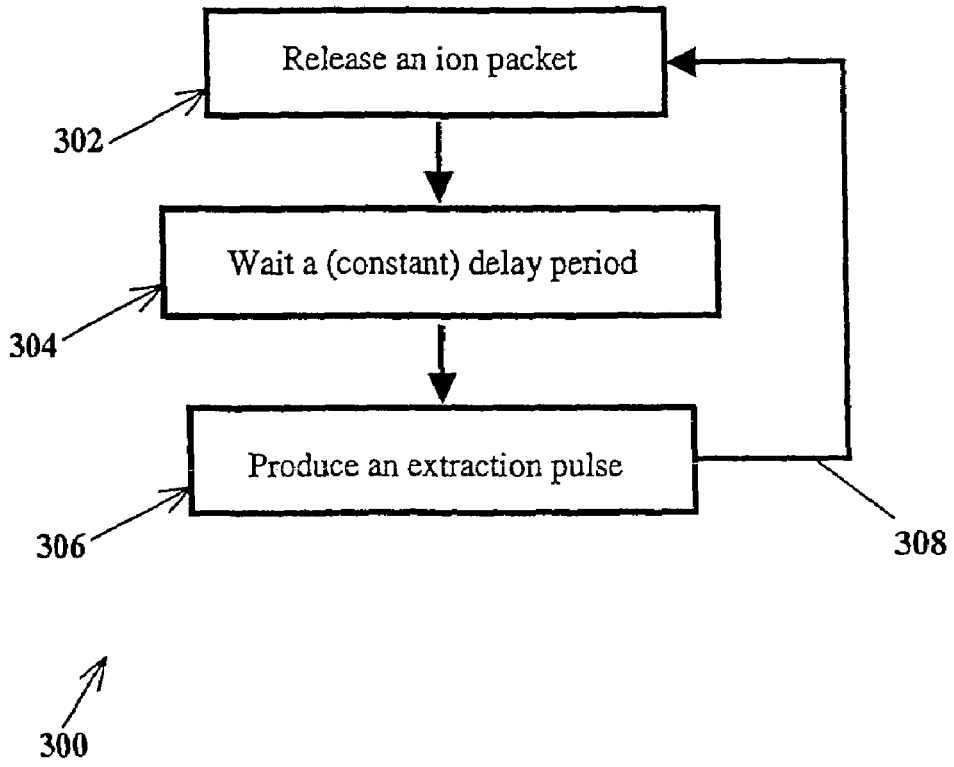
FIG. 3 shows a prior art method of analyzing ions.

As mentioned above, as the ion packet 240 travels from the ion trap 202 to the pulser region 222, mass separation of ions within the packet 240 will typically occur. This mass separation is a well known effect and has been used to advantage to preferentially analyze ions having mass to charge ratio (m/z) within a single pre-selected portion of the spectrum. See U.S. Pat. No. 6,020,586 to Dresch et al. In Dresch et al., the delay between the release of the ion packet from the ion trap and the triggering of the extraction pulse (the "delay period") is selected and set to a constant value that enhances signal from a single desired mass range. Such methods sacrifice a portion of the available ions to focus on the selected range of the spectrum, thereby effectively reducing the duty cycle because the ion packet is larger than can be effectively used by the mass analyzer and detector. FIG. 3 briefly illustrates such a method 300 according to Dresch et al. In FIG. 3, an ion packet is released 302. After waiting the delay period 304, an extraction pulse is triggered to accelerate ions in the ion packet towards the detector 306. As indicated by arrow 308, the process is repeated until the desired amount of data is accumulated.

Figure 4:
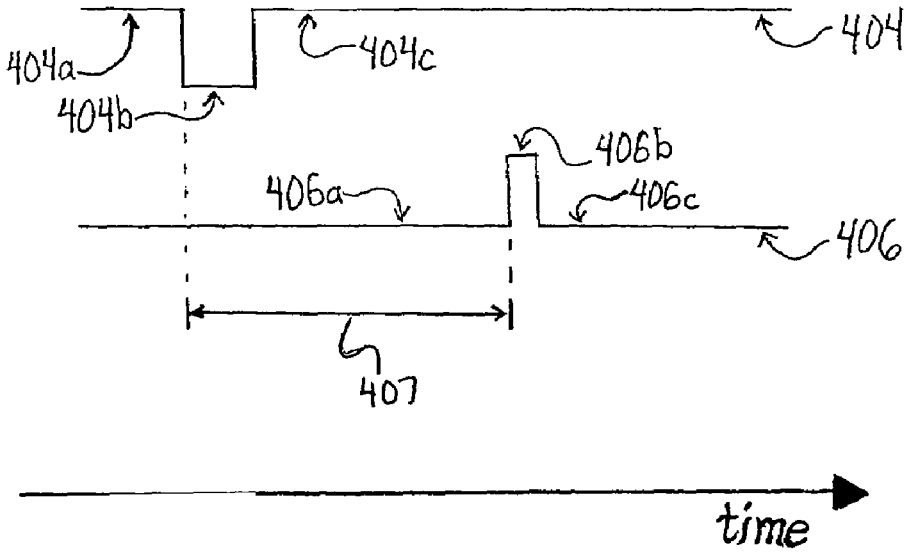
FIG. 4 depicts the relative timing of events of the method shown in FIG. 3.

FIG. 4 shows the timing sequence for the events described in FIG. 3. In FIG. 4, time is shown on horizontal axis 402. The exit gate electrode potential is indicated by the upper trace 404, and the potential applied to the repeller plate is indicated by the lower trace 406. The exit gate electrode potential is initially "high" (indicated at 404*a*), retaining ions in the ion trap. The exit gate electrode potential is then lowered (indicated at 404*b*) to "open" the exit gate, releasing an ion packet. After a brief period of time, the exit gate electrode potential is then raised again (indicated at 404*c*), "closing" the exit gate. The potential applied to the repeller plate is initially low (indicated at 406*a*), allowing the ion packet to enter the pulser region. The potential applied to the repeller plate is then raised (indicated at 406*b*) to produce the extraction pulse, accelerating ions in the ion packet towards the detector. The potential of the repeller plate is then lowered again (indicated at 406*c*). The delay period is indicated at 407 as extending from the opening of the exit gate to the triggering of the extraction pulse. The timing sequence represented by FIG. 4 is repeated many times until the desired amount of data is accumulated in order to produce a final mass spectrum. The delay period 407 remains constant during the repetition in the method according to Dresch et al.

Figure 5:
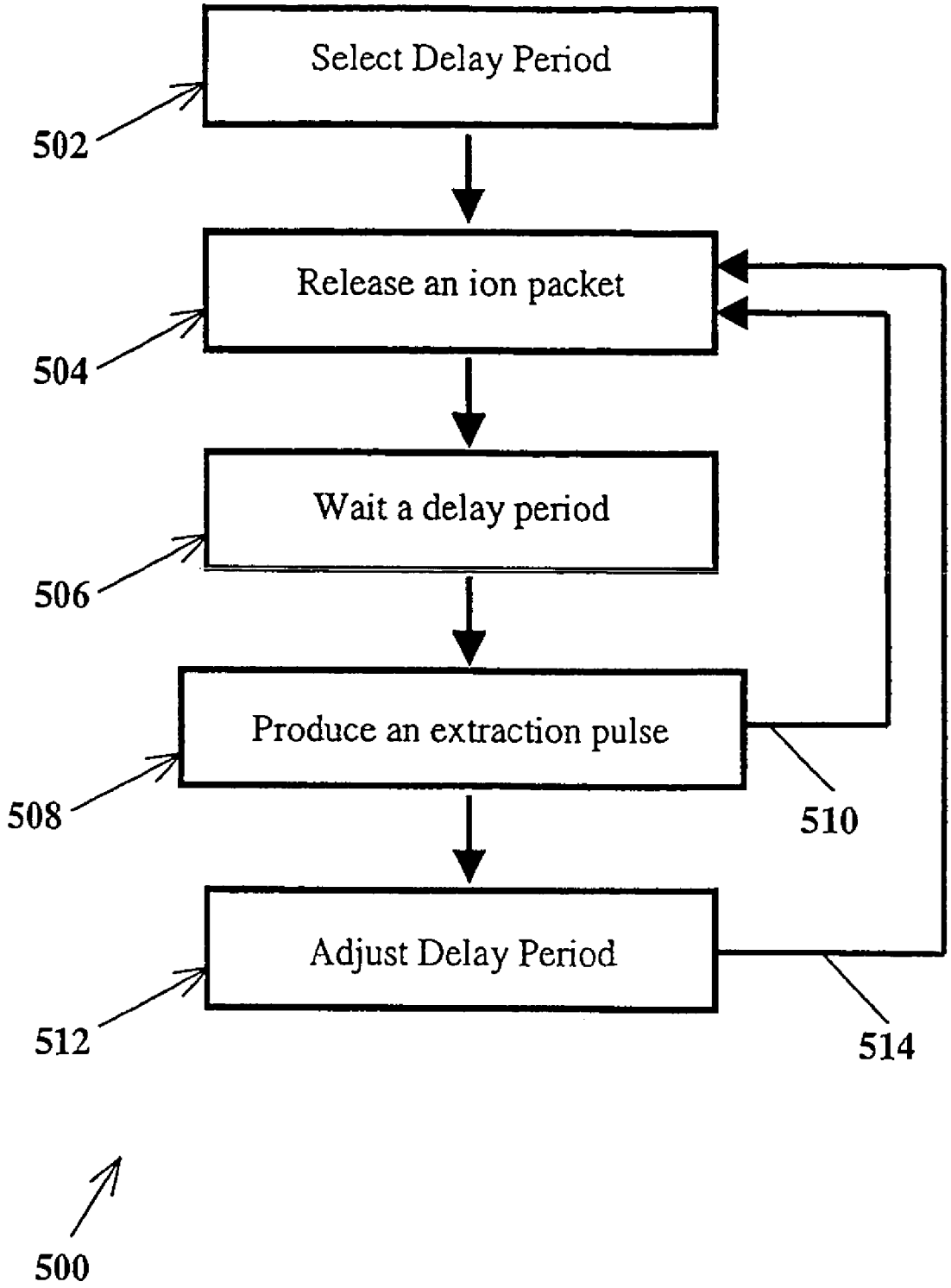
FIG. 5 illustrates one embodiment of a method in accordance with the present invention.

Referring now to FIG. 5, a method 500 of analyzing ions in accordance with the present invention is presented. In the method shown in FIG. 5, a delay period is selected 502. In this step, the delay period may be selected through any appropriate method, as will be apparent to one of skill in the art given the disclosure herein. An ion packet is released 504. After waiting the delay period 506, an extraction pulse is triggered to accelerate ions in the ion packet towards the detector 508. As indicated by arrow 510, the steps of releasing an ion packet 504, waiting the delay period 506, and producing an extraction pulse 508 may (optionally) be repeated. The delay period is adjusted 512, and, as indicated by arrow 514, the steps of releasing an ion packet 504, waiting the delay period 506, producing an extraction pulse 508, and adjusting the delay period 512 are repeated until the desired amount of data is accumulated.

In embodiments in which the steps are repeated as indicated by arrow 510, the steps of releasing an ion packet 504, waiting the delay period 506, and producing an extraction pulse 508 are typically performed at least two, at least three, at least five, or at least ten times each time the delay period is adjusted; in such embodiments in which the steps are repeated as indicated by arrow 510, the steps of releasing an ion packet 504, waiting the delay period 506, and producing an extraction pulse 508 are typically performed fewer than 5000 times, fewer than 1000 times, or fewer than 500 times each time the delay period is adjusted, although in some embodiments this number may exceed 5000 times each time the delay period is adjusted.

The repetition indicated by arrow 514 typically results in the delay period being adjusted at least two times, at least three times, at least five times, at least ten times, at least fifty times, or at least 100 times, and up to about 1000 times, 5000 times, 10,000 times, or even more in certain embodiments. In certain embodiments, the delay period is scanned over a range starting at a relatively large value (relatively long delay) which is decreased (shortening the delay) as the method proceeds. In some such embodiments, the range for the delay period is scanned from an upper value (relatively long delay) to a lower value (relatively short delay), then the delay period is re-set to the upper limit of the range and the method continues; in this fashion, the range for the delay period may be scanned a plurality of times, e.g. at least two times, at least three times, at least five times, at least ten times, at least 50 times, or at least 100 times, and may be scanned up to 500 times or more, e.g. up to 100 times, up to 5000 times, or up to 10,000 times, or more. In certain other embodiments, the delay period is scanned over a range starting at a relatively low value (relatively short delay) which is increased (lengthening the delay) as the method proceeds. In some such embodiments, the range for the delay period is scanned from a lower value (relatively short delay) to an upper value (relatively long delay), then the delay period is re-set to the lower limit of the range and the method continues; in this fashion, the range for the delay period may be scanned a plurality of times, e.g. at least two times, at least three times, at least five times, at least ten times, at least 50 times, or at least 100 times, and may be scanned up to 500 times or more, e.g. up to 100 times, up to 5000 times, or up to 10,000 times, or more.

In particular embodiments, scanning of the delay period comprises adjusting the delay period to at least five different values over a range of delay period, e.g. to at least ten different values over a range of delay period, or to at least 15 different values over a range of delay period, or to at least 20 different values over a range of delay period, or to at least 25 different values over a range of delay period. In particular embodiments scanning of the delay period comprises adjusting the delay period to fewer than about 500 different values over a range of delay period, e.g. to fewer than about 250 different values over a range of delay period, although in some embodiments scanning of the delay period may comprise adjusting the delay period to more then 500 different values over a range of delay period. In particular embodiments, the steps of releasing an ion packet, waiting the delay period, and adjusting the delay period are performed at least three times at each value of delay period in the range of delay period (e.g. at least five times, or at least ten times, or at least 50 times, or at least 100 times) before the delay period is adjusted to a different value of delay period in the range of delay period.

In certain embodiments, the step of adjusting the delay period includes adding a constant increment to a base delay value. This may be represented by the equation $D=b+n\Delta$, wherein D is the adjusted delay period, b is a base value, $\Delta$ is an increment value, and n is a multiplier (e.g. an integer in the range from −100 to +100, typically in the range −50 to +50, more typically in the range −20 to +20) that is adjusted each time the delay period is to be adjusted. In such embodiments, $\Delta$ is a small value selected to scan the delay period over a range effective to accelerate ions in the pulser region towards the detector. In typical embodiments, n is adjusted by adding (or subtracting) a small integer (e.g. 1, 2, 3, 4, or 5, or a positive integer less than about 10). In such embodiments, when n reaches an upper limit (or lower limit) of the desired range, the value of n is re-set to the lower limit (or upper limit) of the desired range and the method continues. In this fashion, the range for the delay period D may be scanned a plurality of times, e.g. at least two times, at least three times, at least five times, at least ten times, at least 50 times, or at least 100 times, and may be scanned up to 500 times or more, e.g. up to 100 times, up to 5000 times, or up to 10,000 times, or more.

In certain embodiments, the delay period is scanned over a range defined by an upper value and a lower value. In some such embodiments, the delay period is scanned from the upper value to a lower value at least two times (or more), e.g. at least three times, e.g. at least 4 times, e.g. at least 5 times, e.g. at least 10 times, e.g. at least 100 times, and may be scanned up to 500 times or more, e.g. up to 100 times, up to 5000 times, or up to 10,000 times, or more.

Figure 6:
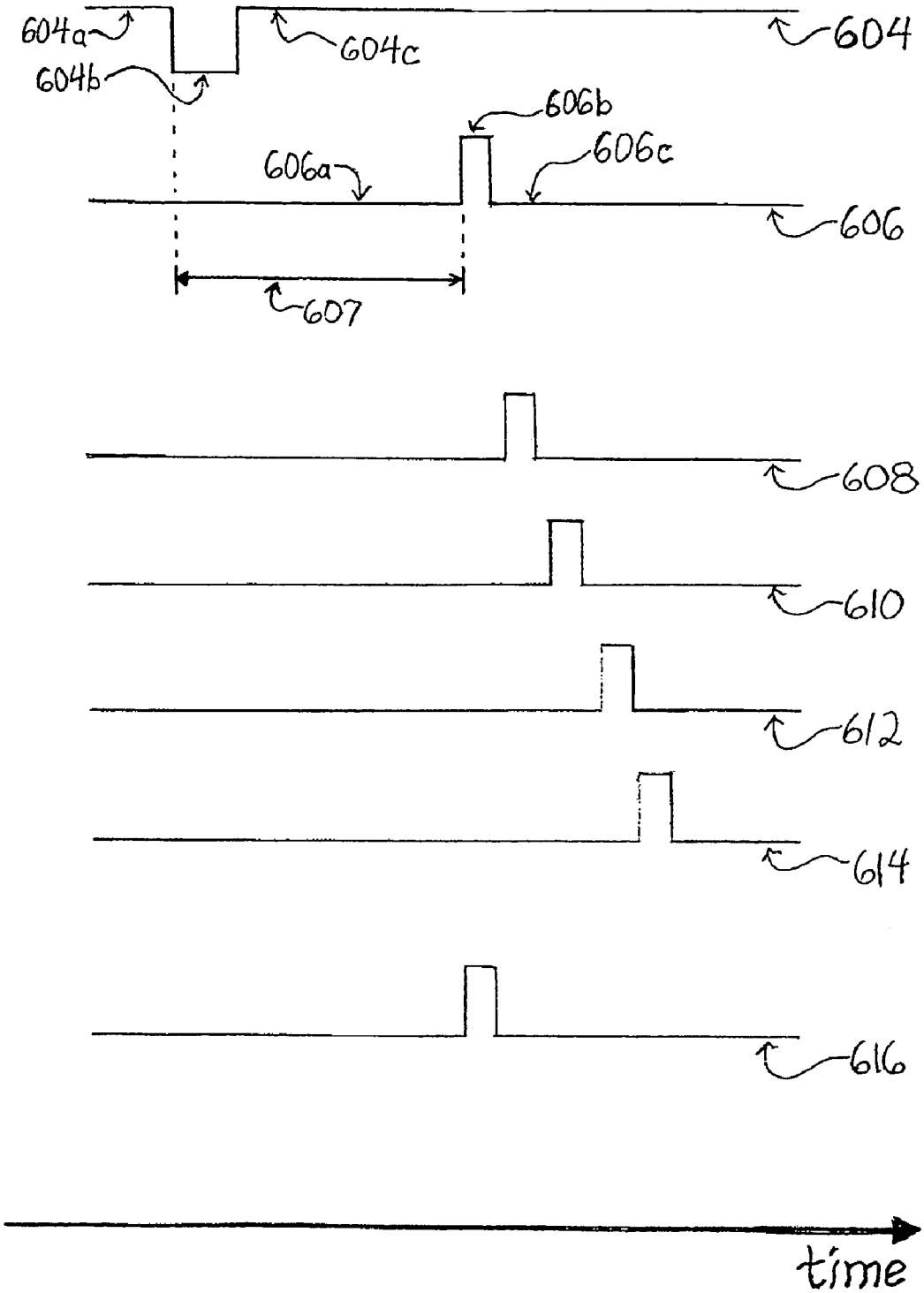
FIG. 6 depicts the relative timing of events of the embodiment shown in FIG. 5.

FIG. 6 illustrates the relative timing of the steps of producing an extraction pulse with respect to the timing of the release of an ion packet. In FIG. 6, traces show relative potentials for each trace (vertical axis) and relative timing (horizontal axis 602). The upper trace 604 indicates the exit gate electrode potential. The lower traces 606, 608, 610, 612, 614, 616 indicate the potential applied to the repeller plate. Referring now to trace 604, the exit gate electrode potential is initially "high" (indicated at 604*a*), retaining ions in the ion trap. The exit gate electrode potential is then lowered (indicated at 604*b*) to "open" the exit gate, releasing an ion packet. The exit gate is held "open" for a brief period of time (the "release duration"), until the exit gate electrode potential is then raised again (indicated at 604*c*), "closing" the exit gate. The potential applied to the repeller plate is initially low (indicated at 606*a*), allowing the ion packet to enter the pulser region. The potential applied to the repeller plate is then raised (indicated at 606*b*) to produce the extraction pulse, accelerating ions in the ion packet towards the detector. The potential of the repeller plate is then lowered again (indicated at 606*c*). The width of the pulse indicated at 606*b*, the "extraction pulse width," is typically in the range from about 1 to about 25 microseconds, more typically from about 3 to about 8 microseconds, although the extraction pulse width may be a value outside these ranges in certain embodiments. The delay period is indicated at 607 as extending from the opening of the exit gate to the triggering of the extraction pulse. Traces 608, 610, 612, 614, 616 indicate the scanning of the delay period by adjusting the delay period across several repetitions of the steps of releasing an ion packet, waiting the delay period, and producing an extraction pulse. Traces 608, 610, 612, 614, 616 show that the delay period is adjusted between traces 608 and 610, and the delay period is again adjusted between 610 and 612, and the delay period is again adjusted between 612 and 614, and the delay period is again adjusted between 614 and 616. Trace 608 shows the delay period adjusted to be longer than the delay period of trace 606. Likewise, trace 610 shows the delay period adjusted to be longer than the delay period of trace 608, and so on. Trace 616 shows that the delay period has been re-set to the initial value shown in trace 606. Each of traces 608, 610, 612, 614, 616 represents the timing of the extraction pulse relative to the release of a corresponding ion packet for that extraction pulse. Note that there may be more traces (not shown), corresponding to even longer delay periods, following trace 614, before the delay period is re-set (indicated by trace 616).

The timing sequence represented by FIG. 6 is repeated until the desired amount of data is accumulated in order to produce a final mass spectrum. In certain embodiments, the delay period may be held at a given value (not adjusted) for a plurality of repetitions of the steps of releasing an ion packet, waiting the delay period, and producing an extraction pulse; such embodiments are illustrated in FIG. 5 by the arrow 510, showing that the steps of releasing an ion packet 504, waiting the delay period 506, and producing an extraction pulse 508 may (optionally) be repeated.

With reference again to FIG. 6, in certain embodiments, the delay period is adjusted for each ion packet, and the traces 606, 608, 610, 612, 614, 616 correspond to successive ion packets released from the ion trap. Such embodiments are represented in FIG. 5 by omitting the optional repetition represented by arrow 510.

Referring again to FIG. 6, the delay period is adjusted as indicated by traces 608, 610, 612, 614, 616. The adjustment of the delay period is typically followed by repeating the steps of releasing an ion packet, waiting the delay period, and producing an extraction pulse; this is illustrated in FIG. 5 by the arrow 514 indicating that the steps of releasing an ion packet 504, waiting the delay period 506, producing an extraction pulse 508, and adjusting the delay period 512 are repeated until the desired amount of data is accumulated.

The delay period may be adjusted to any value within a selected range for the delay period. The selected range for the delay period will be determined with respect to the desired values of mass (or mass to charge ratio, m/z) of the ions of interest, which will vary according to the sample, and will also be determined according to the operational parameters of the mass spectrometer, which also may vary. The delay period will depend on, for example, the configuration of the particular device, the magnitude of the potentials used to accelerate the ions, and the masses of the ions being analysed, among other factors. In typical embodiments, the delay period will be in the range from about 1 microsecond to about 1 millisecond, more typically in the range from about 5 microseconds to about 200 microseconds, although the delay period will be outside the given ranges in certain embodiments. Selection of the selected range is within ordinary skill in the art given the disclosure herein. In typical embodiments, adjusting the delay period will typically involve changing (e.g. increasing or decreasing) the delay period by an amount in the range from about +/−1 microsecond to about +/−100 microseconds, more typically about +/−4 microseconds to about +/−40 microseconds, although adjusting the delay period may involve changing the delay period by an amount outside the indicated ranges; for example, when the scanning of the delay period has reached an upper (or lower) value of the range of delay period and the delay period is re-set to the lower (or upper, respectively) value of the dealy period to continue scanning.

In particular embodiments, the delay period indicated by traces 608, 610, 612, 614, and 616 may be represented as $D=b+n\Delta$, as described above, wherein D is the adjusted delay period, b is a base value, Δ is an increment value, and n is a multiplier (such as n=1 for trace 608) that is adjusted each time the delay period is to be adjusted. In embodiments corresponding to FIG. 6, the base value b is illustrated by the delay period indicated by trace 606. The increment value Δ is indicated by the difference in the delay period of trace 608 as compared to trace 606. In particular embodiments of methods according to the present invention corresponding to FIG. 6, it can be seen from trace 610 that n has been adjusted, e.g. by incrementing to set n=2, thus providing a delay period that is equal to the base value b plus 2Δ. Similarly, trace 612 indicates that n is again adjusted (e.g. to set n=3) to provide the adjusted delay period of $D=b+3\Delta$, and trace 614 indicates that n is again adjusted (e.g. to set n=4) to provide the adjusted delay period of $D=b+4\Delta$. The value of n may thus be varied over a range of n (e.g. wherein the range of n extends from an upper value to a lower value, n is varied between the upper value of the range of n and the lower value of the range of n) to provide for scanning the delay period, e.g. varying the delay period over a range of delay period (e.g. varied between an upper value of the range of delay period and a lower value of the range of delay period). In certain embodiments, when n is adjusted (e.g. incremented or decremented) to a value outside the desired range of n, n is re-set to a value inside the desired range of n, e.g. to the lower value of the range of n or to the upper value of the range of n, and the method of the invention continues. Trace 616 indicates that the delay period has been re-set, for example by re-setting the value of n, e.g. to n=0, thus providing the same delay period as indicated by trace 606. In such embodiments, the method may then continue, e.g. by releasing an ion packet, waiting the delay period, and producing an extraction pulse. In certain embodiments, rather than re-setting the delay period (or n) to a limit value of the range, the direction of the scan is reversed (e.g. to decrement instead of increment, or vice versa); in this manner the delay period may be scanned by first increasing the delay period over the range of delay period and then decreased over the range of delay period (and then increased again, and so on). In certain embodiments, there are m different values of n in the range of n, such that scanning the delay period comprises adjusting the value of n, m times. In such embodiments, m is typically at least 3, more typically at least 5, e.g. at least 10, at least 15, at least 20, at least 25, at least 50, and may be up to 500 or more. In typically embodiments, scanning the delay period over a range of delay period comprises adjusting the delay period to at least 3, or at least 5, or at least 10, or at least 20, or at least 25, or at least 50 different values in the range of delay period, and the delay period may be adjusted to up to 500 or more different values in the range of delay period.

FIG. 6 should be understood to be a figurative representation of certain embodiments of the invention. Other timing sequences will be apparent to the skilled practitioner given the disclosure herein.

In typical embodiments, releasing the ion packet comprises releasing an ion packet that is larger than can be effectively accelerated towards the detector by an extraction pulse in the pulser region. For example, the time that the exit gate is held open (the "release duration") is long enough to produce an ion packet that is larger than can be effectively accelerated towards the detector by an extraction pulse in the pulser region. This can be seen in FIG. 6, in which the release duration is shown by the lowered potential 604*b* of the exit gate potential trace 604. In typical embodiments, the release duration will be in the range from about 100 nanoseconds to about 1 millisecond, more typically from about microseconds to about 400 microseconds, still more typically from about 10 microseconds to about 100 microseconds, although the release duration may be a value outside these ranges in certain embodiments. The ion packet released from the ion trap travels from the ion trap to the pulser region, as explained above with respect to FIG. 2, and, upon arriving at the pulser region, is larger than may be effectively accelerated towards the detector. In typical embodiments, as ion packets are produced, the delay period is adjusted such that delay period is scanned, providing for different relative portions of the ion packets to be accelerated towards the detector. The present invention provides for automatically adjusting the delay period to scan the delay period over a desired range. The delay period is automatically adjusted by, e.g. having a scanning delay timing circuit in operable relation to the time of flight mass analyzer. The scanning delay timing circuit is adapted to triggering an extraction pulse at the pulser region. The scanning delay timing circuit is operable to provide a scanning delay between the release of ions from the ion trap and the triggering of the extraction pulse.

It will be understood that potentials applied to components of a mass spectrometer as described herein will vary depending on the nature of the ions being analyzed. For example, potentials may be adjusted to trap and analyze negatively charged ions, and in such embodiments, potentials will be adjusted to be more negative to trap or repel the ions. In other examples, potentials may be adjusted to trap and analyze positively charged ions, and in such embodiments, potentials will be adjusted to be more positive to trap or repel the ions. Selection of appropriate potentials based on the nature of the ions being analyzed will be apparent to those of ordinary skill in the art given the disclosure herein. "Raising the potential", e.g. the potential applied at a gate electrode (or at a repeller plate), includes embodiments in which the potential is made more positive to confine positive ions (or to accelerate positive ions) and also includes embodiments in which the potential is made more negative to confine negative ions (or to accelerate negative ions).

The practice of the present invention will employ, unless otherwise indicated, conventional techniques of analytical chemistry, analytical instrumentation design, and mass spectrometry instruments and methods, and the like, which are within the skill of the art. Such techniques are explained fully in the literature.

The examples described herein are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C. and pressure is at or near atmospheric. Standard temperature and pressure are defined as 20° C. and 1 atmosphere.

While the foregoing embodiments of the invention have been set forth in considerable detail for the purpose of making a complete disclosure of the invention, it will be apparent to those of skill in the art that numerous changes may be made in such details without departing from the spirit and the principles of the invention. Accordingly, the invention should be limited only by the following claims.

All patents, patent applications, and publications mentioned herein are hereby incorporated by reference in their entireties.

What is claimed is:

1. An apparatus for analyzing ions comprising:

an ion source;

an ion trap disposed to receive ions from said ion source;

a time of flight mass analyzer comprising a pulser region, said pulser region disposed to receive ions from said ion trap;

a detector operatively coupled to said time of flight mass analyzer; and a controller configured to control releases of ion packets from said ion trap, said ion packets being larger than said pulser region and larger than can be effectively accelerated toward said detector from said pulser region by an extraction pulse; said controller including a scanning delay timing circuit in operable relation to said pulser region, said scanning delay timing circuit adapted to triggering an extraction pulse at said pulser region to accelerate a portion of an ion packet released by said ion trap, after a delay time following a time of release of said packet, said scanning delay timing circuit configured to scan the delay time to incrementally or decrementally alter the delay time with subsequent releases of said ion packets, to effect acceleration of different portions of said ion packets.

2. The apparatus of claim 1 wherein the ion trap comprises a multipole.

3. The apparatus of claim 2, wherein the multipole is selected from one of the group consisting of: a quadrupole, a hexapole, and a multipole comprising eight or more rods.

4. The apparatus of claim 1, wherein the ion trap is selected from a linear ion trap or a three dimensional ion trap.

5. The apparatus of claim 1, wherein the time of flight mass analyzer comprises a reflectron.

6. The apparatus of claim 1 wherein the ion trap is disposed to release ions on a trajectory substantially orthogonal to the time of flight mass analyzer.

7. A method of analyzing ions in a mass spectrometer, the mass spectrometer comprising an ion trap, a time of flight mass analyzer, a pulser region, and a detector, the method comprising:

a) selecting a delay period;

b) releasing an ion packet from the ion trap, wherein the ion trap is only partially emptied, and wherein said ion packet is larger than said pulser region and larger than can be effectively accelerated toward said detector from said pulser region by an extraction pulse;

c) waiting the delay period;

d) producing an extraction pulse to accelerate a portion of the ion packet into the time of flight mass analyzer to the detector;

e) adjusting the delay period;

f) repeating steps b), c), d) and e), wherein the delay period is scanned by said repetition of said adjusting the delay period step, over a range providing for accelerating different portions of the ion packet into the time of flight mass analyzer to the detector.

8. The method of claim 7, wherein each time step e) is performed, steps b), c) and d) are performed at least twice.

9. The method of claim 7, wherein each time step e) is performed, steps b), c) and d) are performed at least three times.

10. The method of claim 7, wherein each time step e) is performed, steps b), c) and d)are performed at least ten times.

11. The method of claim 7, wherein adjusting the delay period comprises adding a fixed increment to the delay period to provide for the delay period being scanned over the range as steps b), c) and d) are repeated.

12. The method of claim 11 wherein the delay period is reset when the delay period is outside of the range providing for accelerating different portions of the ion packet into the time of flight mass analyzer to the detector.

13. The method of claim 7, wherein repeating steps b), c), d) and e) provides for the delay period being scanned from a lower value to an upper value at least once.

14. The method of claim 13 wherein the delay period is scanned from a lower value to an upper value at least ten times.

15. The method of claim 7, wherein repeating steps b), c), d) and e) provides for the delay period being scanned from an upper value to a lower value at least once.

16. The method of claim 15, wherein the delay period is scanned from the upper value to the lower value at least ten times.

17. The method of claim 7, further comprising, before releasing the ion packet, selecting a release duration to set the size of the ion packet.

18. The apparatus of claim 1, wherein said scanning delay timing circuit maintains the delay time for a predetermined number of ion packet releases and extraction pulses before incrementing said delay time for a subsequent series of ion packet releases.

19. The apparatus of claim 1, wherein said scanning delay timing circuit increments said delay time with each release of an ion packet.

20. The apparatus of claim 1, wherein said scanning delay timing circuit increments said delay time from an original preset delay time, to a maximum delay time.

21. The apparatus of claim 20, wherein said scanning delay timing circuit decrements said delay time from said maximum delay time to a predetermined lesser delay time.

* * * * *